US011623469B2

(12) United States Patent
Lee, Jr. et al.

(10) Patent No.: US 11,623,469 B2
(45) Date of Patent: Apr. 11, 2023

(54) METHOD FOR MASS PRODUCTION OF CUSTOMIZED DECORATIVE ART

(71) Applicants: Ronald Lee, Jr., Ruskin, FL (US); Anthony Sansone, Parrish, FL (US)

(72) Inventors: Ronald Lee, Jr., Ruskin, FL (US); Anthony Sansone, Parrish, FL (US)

( * ) Notice: Subject to any disclaimer, the term of this patent is extended or adjusted under 35 U.S.C. 154(b) by 399 days.

(21) Appl. No.: 16/948,181

(22) Filed: Sep. 8, 2020

(65) Prior Publication Data

US 2022/0072896 A1 Mar. 10, 2022

(51) Int. Cl.

| | |
|---|---|
| ***B44C 3/08*** | (2006.01) |
| ***B44C 3/12*** | (2006.01) |
| ***B44C 5/04*** | (2006.01) |
| ***B44C 1/22*** | (2006.01) |

(52) U.S. Cl.

CPC ..... *B44C 3/082* (2013.01); *B44C 1/227* (2013.01); *B44C 3/12* (2013.01); *B44C 5/0415* (2013.01); *B44C 5/0446* (2013.01)

(58) Field of Classification Search

CPC ..... B44C 3/082; B44C 3/12; B44C 1/227; B44C 1/00

See application file for complete search history.

(56) References Cited

U.S. PATENT DOCUMENTS

| | | | | |
|---|---|---|---|---|
| 2,032,039 | A | 2/1936 | Ballou | |
| 4,125,655 | A | 11/1978 | Kanzelberger | |
| 5,343,646 | A | 9/1994 | Cobb et al. | |
| 5,428,914 | A * | 7/1995 | Whitehouse | G09F 15/0006 40/594 |
| 5,649,220 | A | 7/1997 | Yosefi | |
| 7,164,490 | B2 | 1/2007 | Manico et al. | |
| 7,656,402 | B2 | 2/2010 | Abraham et al. | |
| 7,877,909 | B1 | 2/2011 | Hagen et al. | |
| 8,050,796 | B1 | 11/2011 | Hagen et al. | |
| 8,413,357 | B1 | 4/2013 | Hagen | |
| 8,574,714 | B2 | 11/2013 | Giori | |
| 8,832,977 | B1 | 9/2014 | Salen | |
| 9,728,109 | B1 * | 8/2017 | Weisburn | G09F 7/18 |
| 9,849,844 | B2 | 12/2017 | Hannel | |
| 10,304,107 | B2 | 5/2019 | Tuchler et al. | |
| 2002/0198892 | A1 | 12/2002 | Rychel | |
| 2007/0283601 | A1 | 12/2007 | Peterson | |
| 2008/0057330 | A1 * | 3/2008 | Boushey | B44C 5/005 29/458 |
| 2011/0030253 | A1 | 2/2011 | Fahey | |
| 2011/0282476 | A1 | 11/2011 | Hegemier | |
| 2013/0140746 | A1 | 6/2013 | Heverly et al. | |
| 2017/0031346 | A1 | 2/2017 | Kessinger | |

(Continued)

*Primary Examiner* — Jason L Vaughan
*Assistant Examiner* — Amanda Kreiling
(74) *Attorney, Agent, or Firm* — Mark Young, PA

(57) ABSTRACT

A method of producing customized artwork includes forming and finishing a plurality of backdrops by cutting and/or engraving sheet metal. Based upon an order received for a customized artwork a particular backdrop is selected and a customized ornamental component is produced in sheet metal. If the backdrop and customized component are prone to galvanic corrosion, insulation may be provided between the customized component and backdrop and to insulate fasteners from either the customized component or backdrop. The method reduces lead times and production costs for customized artwork, while improving quality of the final product.

20 Claims, 7 Drawing Sheets

(56) References Cited

U.S. PATENT DOCUMENTS

| | | | |
|---|---|---|---|
| 2017/0057268 | A1 | 3/2017 | Surber |
| 2017/0087873 | A1 | 3/2017 | Freybler et al. |
| 2020/0062026 | A1 | 2/2020 | Thomson |

* cited by examiner

METHOD FOR MASS PRODUCTION OF CUSTOMIZED DECORATIVE ART

FIELD OF THE INVENTION

This invention relates generally to production of customized decorative art, and, more particularly, to a method for efficiently producing art in separate pieces.

BACKGROUND

Current customized artwork products offered for sale have extended manufacturing lead times. Mass producers of the artwork are unable to keep inventory of customized artwork. All pieces are cut, prepped, and finished only after the order is placed. Hobbyist type businesses are able to offer shorter lead times, but they are unable to meet the volume requirements of mass production.

The proliferation of computer numerical controlled machines has made it easier for producers to form artwork. Such machines include sheet metal cutting machines, into which ornate decorative patterns may be cut and etched. However, finishing operations in which the workpiece is treated to form a protective and/or decorative coating, require different equipment and a different skill set. Many producers outsource finishing to businesses who have the equipment and expertise to perform the operation.

Thus, when a customer orders a customized artwork product, the manufacturer forms and finishes the entire product, the non-customized portion as well as the customized portion, typically out of the same material. Finishing takes considerable time. Many producers outsource finishing, which introduces additional shipping delays. Depending upon backlog, months may pass from the time a customer places an order until order fulfillment.

Production of artwork one-at-a-time to fulfill an order not only wastes time, but increases cost. Economies of scale are lost in such productions.

An economical method that streamlines the manufacturing process from months to hours is needed. The method should facilitate the production and delivery of finished artwork suitable for display indoors and outdoors in most environments.

The invention is directed to overcoming one or more of the problems and solving one or more of the needs as set forth above.

SUMMARY OF THE INVENTION

To solve one or more of the problems set forth above, in an exemplary implementation of the invention, a method of producing customized artwork includes forming a plurality of backdrops. Each backdrop of the plurality of backdrops features an ornamental design formed in a metal sheet. Each backdrop also has a mounting area. The backdrops are not customized for users. Each backdrop of the plurality of backdrops has surfaces. The backdrops are finished. Finishing entails treating the surfaces of each backdrop of the plurality of backdrops. An order is received for a customized artwork. The customized artwork includes a selected backdrop and a customized component. The selected backdrop is one backdrop of the plurality of backdrops. The customized component is produced from another metal sheet (i.e., a metal sheet different from the sheet from which the selected backdrop was produced). The customized component features a second ornamental design formed in the other metal sheet. The produced customized artwork is delivered.

The plurality of backdrops may be stored as inventory, after they are formed. Thus, customers may select from a plurality of backdrops in inventory.

The customized artwork may be delivered disassembled or assembled. The method may entail determining whether to assemble the customized artwork by fastening the customized component to the mounting area of the selected backdrop, before delivering the customized artwork.

The plurality of backdrops may be formed by cutting and/or engraving an ornamental design in the metal sheet for each backdrop. Similarly, the customized component may be produced by cutting and/or engraving the second ornamental design in the other metal sheet for the customized component.

In a preferred implementation, the method includes a step of determining whether to insulate the customized component from the selected backdrop to hinder galvanic corrosion. The step of determining whether to insulate the customized component from the selected backdrop is performed after receiving the order for the customized artwork. A first anodic index is determined for the selected backdrop. A second anodic index is determined for the customized component. The difference between the first anodic index for the selected backdrop and the second anodic index for the customized component is determined. If the difference exceeds a determined amount insulation is provided. The insulation includes an insulator disposed between the selected backdrop and the customized component. The insulation may also include an insulating flanged bushing for each fastener used to fasten the customized component to the mounting area of the selected backdrop. The insulating flanged bushing insulates each fastener from the backdrop, or insulates each fastener from the customized component.

BRIEF DESCRIPTION OF THE DRAWINGS

The foregoing and other aspects, objects, features and advantages of the invention will become better understood with reference to the following description, appended claims, and accompanying drawings, where:

Those skilled in the art will appreciate that the figures are not intended to be drawn to any particular scale; nor are the figures intended to illustrate every embodiment of the invention. The invention is not limited to the exemplary embodiments depicted in the figures or the specific components, configurations, shapes, relative sizes, ornamental aspects or proportions as shown in the figures.

DETAILED DESCRIPTION

A method according to principles of the invention produces customized artwork comprised of a backdrop and a trim. Backdrops are produced, finished and inventoried in advance. Trims are specified by customers at the time of orders. With the backdrop in inventory, only the trim must be produced to fulfill an order. The trim is produced of a material that does not require finishing or that is limited to rapid on-site finishing. If the trim and backdrop risk galvanic corrosion, insulation may optionally be included. The artwork may be delivered assembled or disassembled.

Figure 1:
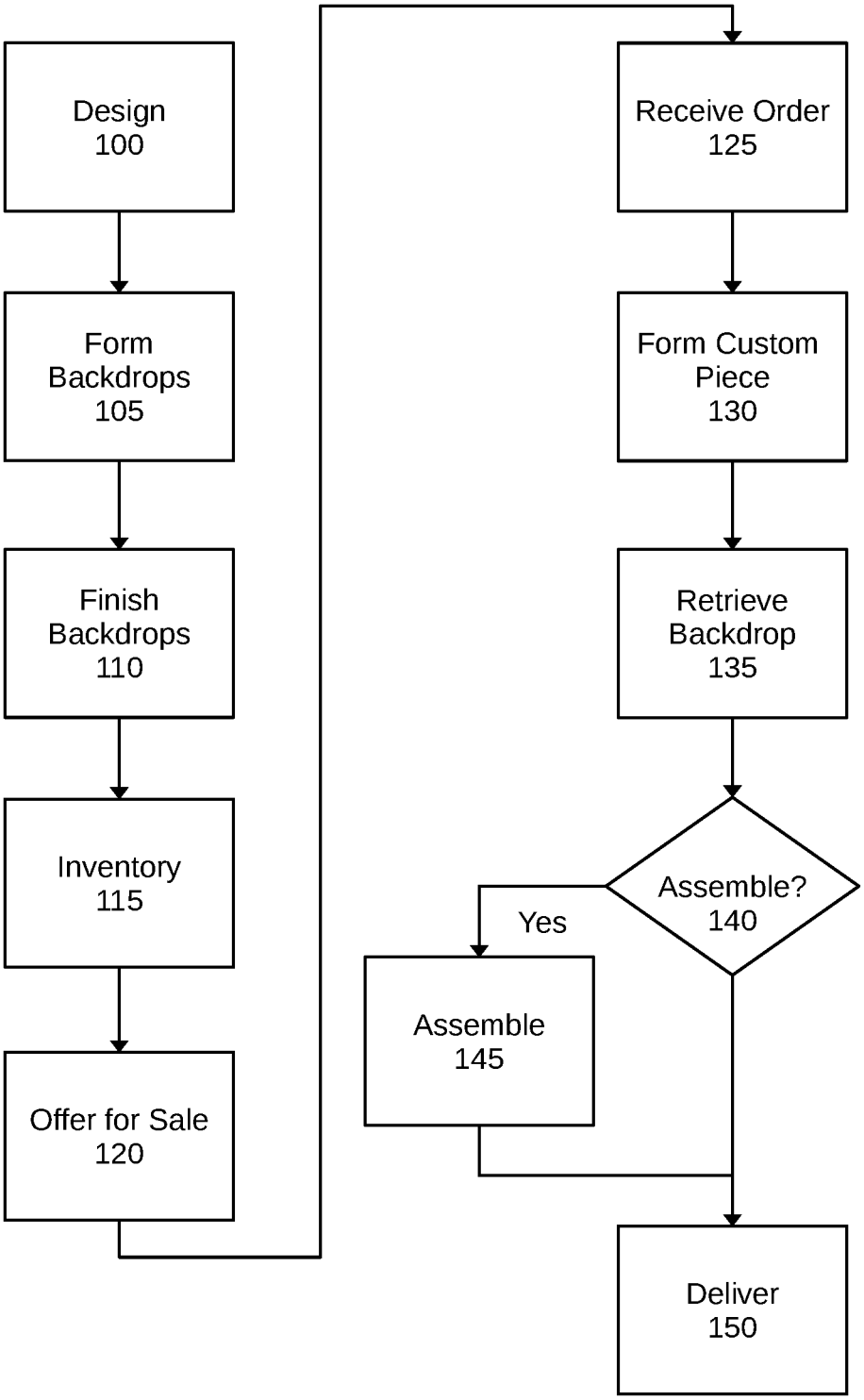
FIG. 1 is a flowchart of steps of an exemplary method for mass production of customized decorative art according to principles of the invention.

With reference to FIG. 1, in step 100 of an exemplary process, the artwork is designed. Artwork according to principles of the invention includes at least two parts—a backdrop and a trim, each formed of a durable material, preferably metal. In a preferred implementation, many backdrops are designed to offer consumers a range of choices. The trim may be designed and formed in subsequent steps, when and after a consumer places an order. The design step may entail producing a backdrop design suitable for the forming step 105. In the case of forming by cutting metal sheet, the design may comprise producing a 2-dimensional computer aided design (CAD) drawing of the backdrop. In the design, all cutting contours should be closed to remove the part from the raw sheet metal. Lines meant for engraving or etching do not have to be closed. In the design, line color and line thickness may be controlled to distinguish lines for cutting from lines for etching. If the backdrop requires holes with tight tolerances, the sheet metal may be pierced. Subsequently, a hole may be bored with a drill bit, using the piercing hole as a guide. When cutting multiple parts from the same sheet of metal, a distance of at least the material's thickness should be left between them. The design preferably conforms with these guidelines.

In step 105 of the exemplary process, the backdrop is formed. In the case of a backdrop formed from sheet metal, the backdrop may be formed by cutting. The cutting may be performed with a CNC machine, such as a CNC milling machine, a CNC plasma cutter, a CNC laser cutter, or a CNC water jet cutter. Codes for controlling operation of the cutter are generated by computer-aided manufacturing (CAM) software. The design created in step 100 is imported into or opened in the CAM software. The CAM software produces the codes (e.g., G-codes and M-codes), as a sequence of instructions, for controlling operation of the machine and achieving cuts according to the design.

In step 110 of the exemplary process, the backdrop is finished. Metal finishing may encompass any of a range of processes. These processes are varied, complex and involve chemical and physical processing steps. Many consume considerable time and require careful administration for safety and legal compliance. Nonlimiting examples of finishes are electroplating, painting, electrophoretic coating, powder coating, conversion coating (e.g., passivation, phosphating, anodizing, mechanical plating) and galvanizing.

In step 115 of the exemplary process, the finished backdrop is placed in inventory for sale. Maintaining an inventory achieves several objectives. Inventory substantially reduces time lags present in the supply chain for customized artwork. Inventory ensures capacity to meet seasonal and unexpected demand. Economies of scale are achieved because it is less costly to mass produce a particular backdrop than it is to produce one backdrop at a time as needed. Additionally, inventoried backdrops may appreciate as raw material costs increase and the business of producing and selling customized artwork grows.

The artwork is offered for sale in step 120 of the exemplary process. This step may entail advertising, marketing and promotion of the customized artwork. Pricing or estimated pricing and examples of prior customized artwork may be presented to inform and inspire potential buyers. At this step, the backdrop, which comprises a substantial portion, and in most cases the majority of the artwork is formed, finished and ready for immediate shipping.

In step 125 of the exemplary process, an order for customized artwork is received. The order specifies at least a backdrop and trim. The specification of the trim may include a detailed dimensioned scaled drawing, such as a CAD or vector graphics drawing. The drawing may be produced by the buyer, or the seller or a third party in collaboration with the buyer. The specification of the trim may also include material specifications. In a preferred implementation, the trim is produced using a material that does not require finishing or further finishing. As finishing operations can appreciably delay order fulfillment, further finishing of the trim is to be avoided.

In step 130 of the exemplary process, the trim is formed. The piece is preferably formed of a material that will not rust under normal conditions, such as aluminum or stainless steel. If the piece is metal and will be exposed to corrosive conditions, such as an environment exposing the piece to sulfides or chlorides, e.g., chlorides in salt water, then a corrosion resistant finish is recommended. In another embodiment, the material from which the trim is formed may be pre-finished, leaving only cut edges vulnerable to corrosion if the piece is displayed in a corrosive environment. In another embodiment, the trim is composed of a plastic. The trim may include mounting features (e.g., flanges and/or holes) for attaching the piece to a backdrop.

In the case of a trim formed from sheet metal, the piece may be formed by cutting. The cutting may be performed with a CNC machine, such as a CNC milling machine, a CNC plasma cutter, a CNC laser cutter, or a CNC water jet cutter. Codes for controlling operation of the cutter are generated by computer-aided manufacturing (CAM) software. The design specified in step 125 is imported into or opened in the CAM software. The CAM software produces the codes (e.g., G-codes and M-codes), as a sequence of instructions, for controlling operation of the machine and achieving cuts according to the design.

In the case of a trim formed from plastic or metal, the piece may be formed by additive manufacturing (e.g., 3D printing) or milling.

In step 135 of the exemplary process, the backdrop is retrieved from inventory. The retrieved backdrop is the finished backdrop required to fulfill the order received in step 125. Upon retrieval, the inventory for the retrieved backdrop is reduced by one.

In step 140 of the exemplary process, a determination is made whether to assemble the artwork. Assembly entails attaching the trim to the backdrop. The artwork may be delivered assembled or disassembled. Whether to assemble may be a customer's option or a matter of policy for a seller.

If assembly is required before delivery, the artwork is assembled before delivery as in step 145. Assembly may entail fastening the trim to the backdrop. By way of example and not limitation, mechanical fasteners (screws, nuts and bolts, rivets) or welds may be used.

In one implementation, assembly may optionally include steps for determining if the artwork requires insulation. Such steps are described below with reference to FIG. 2. If the artwork will be delivered disassembled, then such steps may be performed as part of the delivery step 150.

In step 150 of the exemplary process, the artwork is delivered. If the artwork has been assembled in step 145, the artwork is delivered as assembled. If the artwork has not been assembled in step 145, the artwork is delivered unassembled. Hardware such as mechanical fasteners and insulators may be included with the artwork components.

Figure 2:
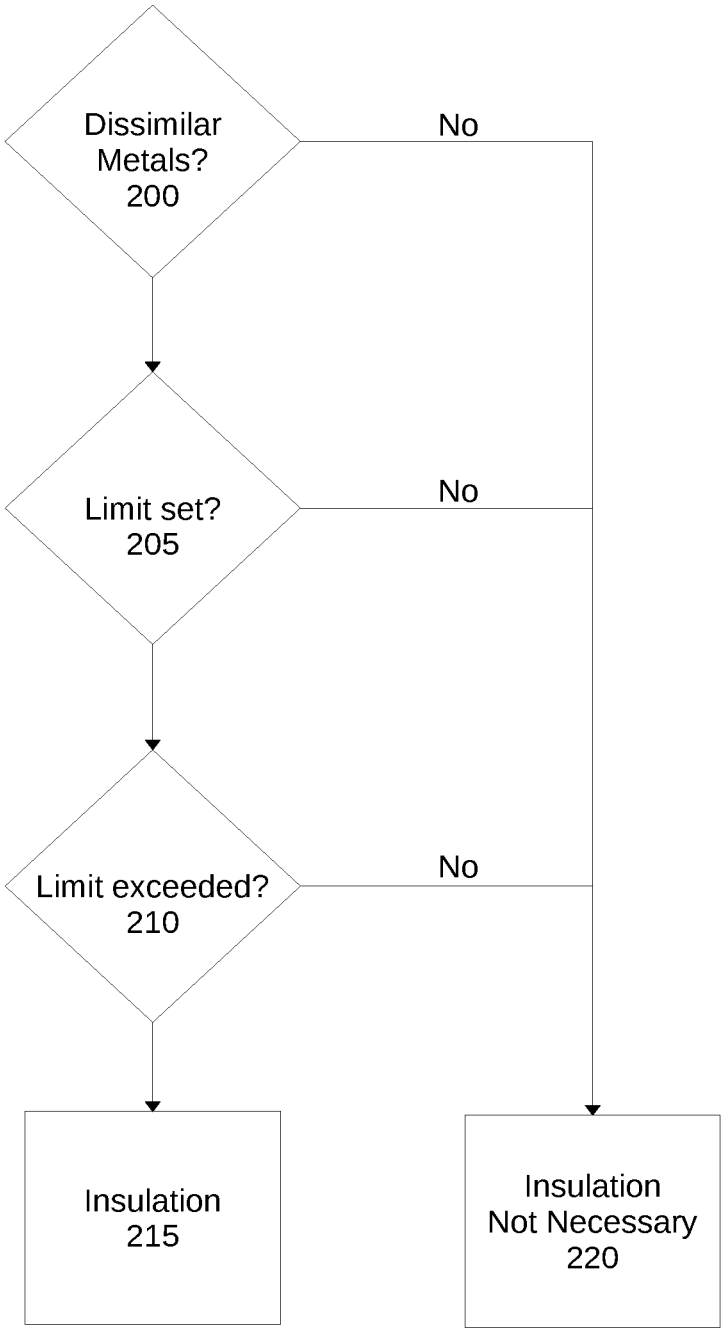
FIG. 2 is a flowchart of additional steps of an exemplary method for mass production of customized decorative art according to principles of the invention.

FIG. 2 provides a flowchart of additional steps of an exemplary method for mass production of customized decorative art according to principles of the invention. The additional steps determine whether to include insulation. In step 200, a determination is made as to whether the abutting surfaces of the separate components of the artwork (i.e., backdrop and trim) are comprised of dissimilar metals. Of particular interest is the finished surface of the backdrop. If the finished surface of the backdrop and the trim are comprised of the same metals, then the risk of galvanic corrosion is low. In such case, where the risk of galvanic corrosion is low, insulation may be unnecessary, as in step 220. If the finished surface of the backdrop is not comprised of metal, but rather is an enamel or porcelain, then the finished surface of the backdrop and the trim are not comprised of dissimilar metals, because the enamel or porcelain are not metal. Again, in such case, the risk of galvanic corrosion is low.

In contrast, if the finished surface of the backdrop and the trim are comprised of different (i.e., dissimilar) metals, then control proceeds to step 205. By way of illustration, if the backdrop is unfinished stainless steel and the custom component is aluminum, then the risk of galvanic corrosion is relatively high. In such case, control proceeds to step 205.

In step 205, a determination is made whether a limit has been exceeded. The limit is the maximum difference between the anodic indices for the different metals. Compatibility of different metals may be predicted by consideration of their anodic indices. An anodic index is a measure of the electrochemical voltage that will be developed between the metal and gold. The relative voltage of a pair of dissimilar metals is the difference between their anodic indices. To reduce risk of galvanic corrosion, the difference should be less than the limit. By way of example and not limitation, the limit may set at a value from 0.05 to 0.50V, or more preferably, from 0.10 to 0.25V, or 0.10V, 0.15V, 0.20V, or 0.25V.

The limit may be fixed or variable. In the latter case, the limit may determined based upon environmental conditions. Artwork stored outdoors is more susceptible to galvanic corrosion than artwork kept indoors. Artwork stored in a humid environment is more susceptible to galvanic corrosion than artwork kept in a dry environment. Artwork stored near salt water as in a seaside community is much more susceptible to galvanic corrosion than artwork kept away from a salt water environment. Thus, the limit may be set according to average precipitation, humidity and proximity to salt water. Illustratively, the limit for artwork to be displayed outdoors in a seaside community may be 0.05V, while the limit for artwork to be displayed outdoors in an arid desert community may be 0.25.

Insulation will not cause harm if it is not needed. Thus, a producer may decide to provide insulation in all cases or may set the limit low (e.g., 0.01V).

If the difference between the anodic indices for the different metals exceeds the applicable limit, then insulation may be provided as in step 210. If the difference between the anodic indices for the different metals does not exceed the applicable limit, then insulation may be omitted as in step 215.

Figure 3:
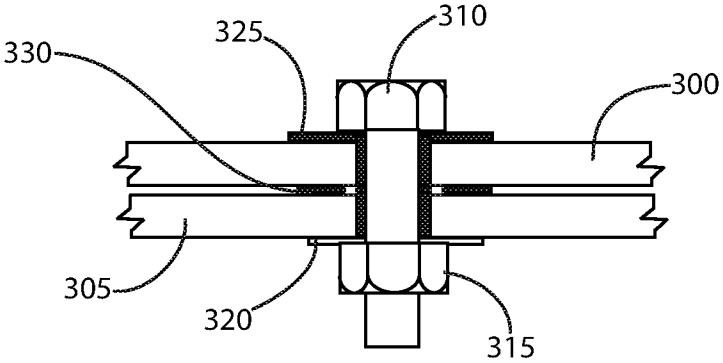
FIG. 3 is a schematic of fastening an exemplary trim to a backdrop according to principles of the invention.

FIG. 3 provides a schematic of an exemplary fastening system for attaching a trim 300 to a backdrop 305 according to principles of the invention. Illustratively, the trim 300 may be aluminum and the backdrop 305 may be stainless steel. To avoid galvanic corrosion, a non-conductive insulating (e.g., plastic or rubber) gasket 330 is disposed between the trim 300 and backdrop 305. The fastener is a stainless steel bolt 315, washer 320 and nut 315. The stainless steel fastener may contact the stainless steel backdrop 305, without risk of galvanic corrosion, because the fastener and backdrop are composed of the same material. A flanged bushing 325 separates the head and shank of the bolt 315 from the dissimilar metal, i.e., the aluminum trim 300. The flanged bushing 325 is composed of a non-conductive insulating material such as rubber or plastic. Thus, the trim 300 does not directly contact the fastener or the backdrop 305.

In the example described above with reference to FIG. 3, the fastener is composed of the same material as the backdrop 305. In another example, the fastener may be composed of the same material as the trim 300, and the flanged bushing 325 may be arranged to insulate the fastener from the backdrop 305, and the gasket 330 may, as in the example of FIG. 3, insulate the backdrop 305 from the trim 300.

Figure 4:
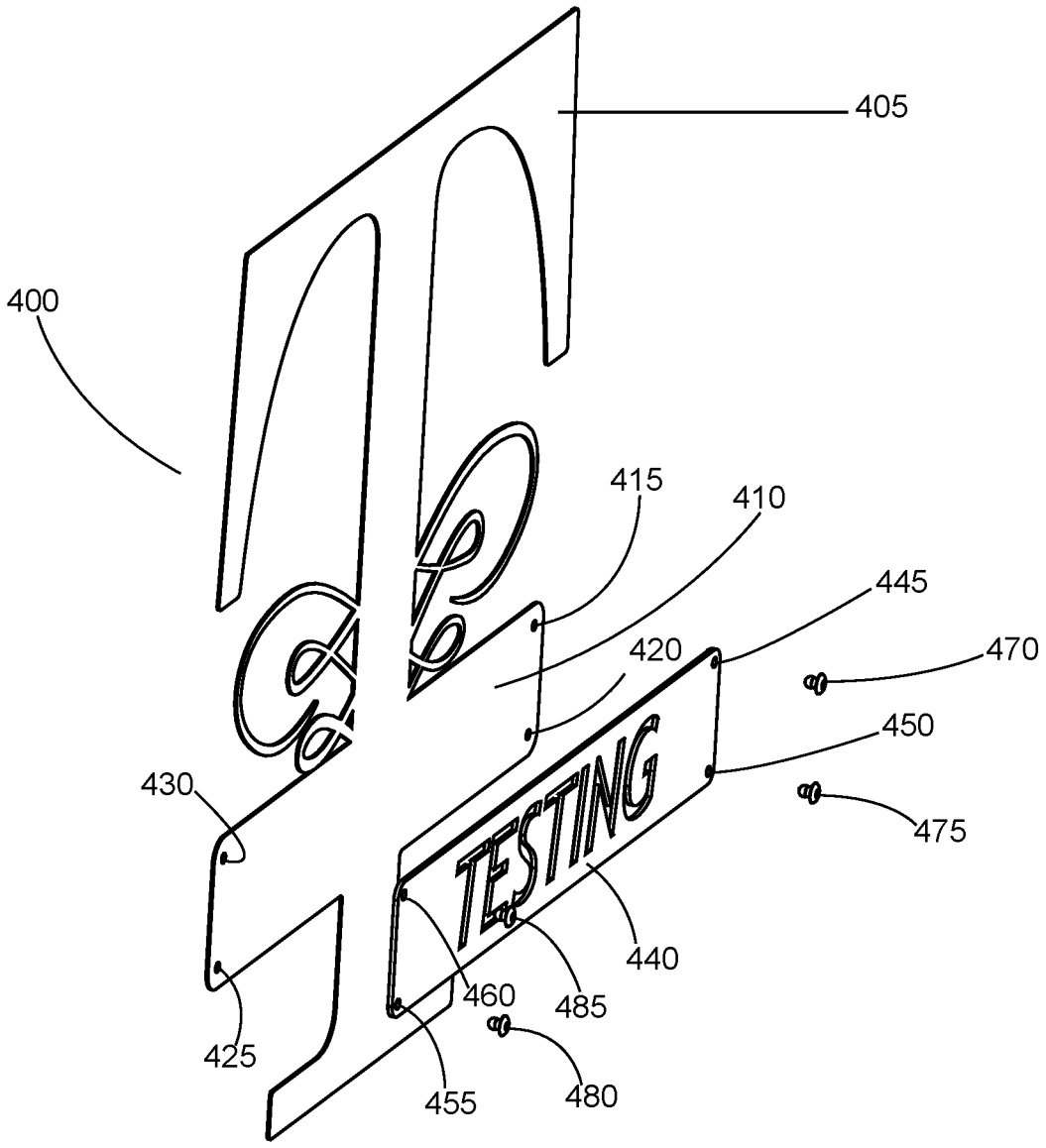
FIG. 4 is a perspective exploded view of a customized decorative art assembly according to principles of the invention.
Figure 5:
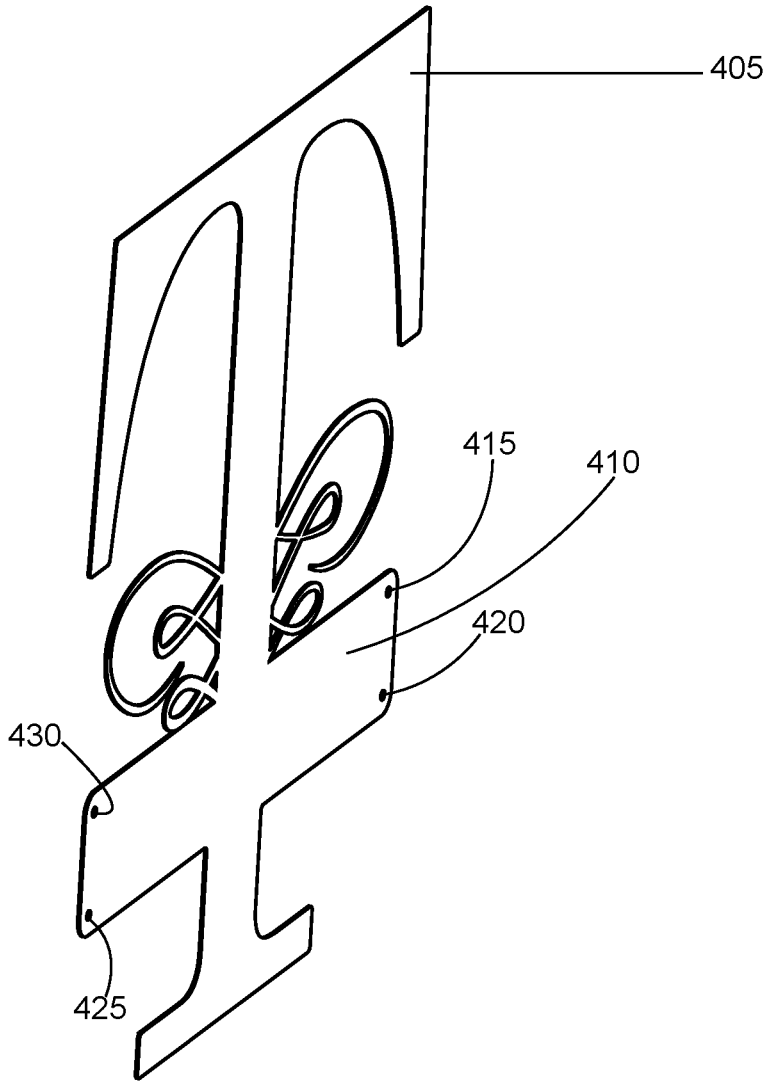
FIG. 5 is a perspective view of a backdrop of a customized decorative art assembly according to principles of the invention.
Figure 6:
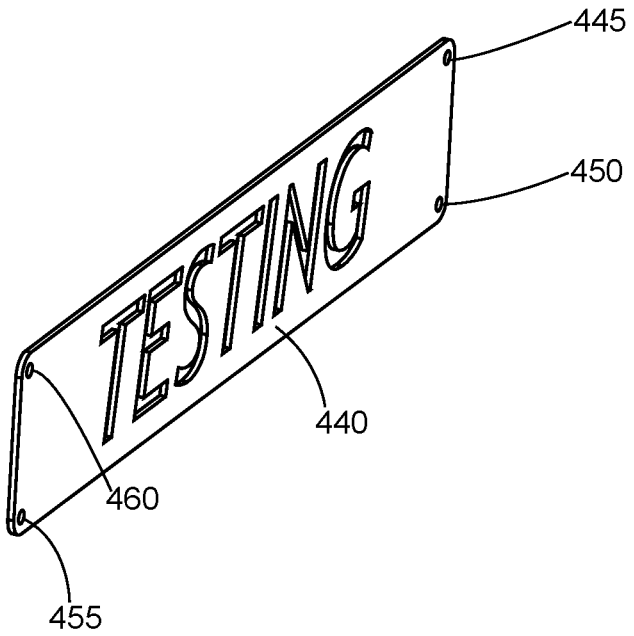
FIG. 6 is a perspective exploded view of a customized portion for a customized decorative art assembly according to principles of the invention.

FIGS. 4-6 provide perspective views of components of an exemplary customized decorative art assembly 400 according to principles of the invention. The assembly 400 includes an ornamental backdrop 405 with a trim mount 410. The invention is not limited to any particular ornamental features. The trim 440 attaches to the trim mount 410. In the exemplary embodiment, the trim 440 includes a plurality of mounting holes 445-460 that align with corresponding mounting holes 415-430 on the trim mount 440. Fasteners 445-460 attach the trim 440 to the trim mount 410 of the backdrop 405. By way of example and not limitation, the fasteners 445-460 may be rivets, screws, or nuts and bolts. An insulating gasket 350 and flanged bushing 325, as described above, may be used, particularly if the backdrop 405 and trim 440 are composed of dissimilar metals.

Figure 7:
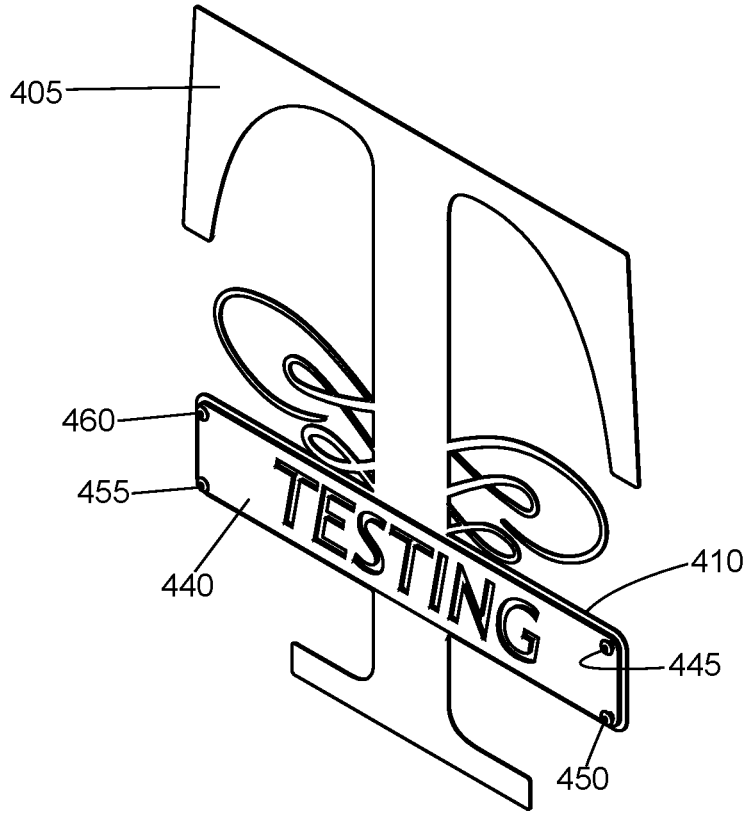
FIG. 7 is a perspective assembled view of a customized decorative art assembly according to principles of the invention.

FIG. 7 is a perspective assembled view of the customized decorative art assembly 400 according to principles of the invention. The fasteners 445-460, with or without optional insulation, secure the trim 440 to the trim mount 410 of the backdrop 405.

While an exemplary embodiment of the invention has been described, it should be apparent that modifications and variations thereto are possible, all of which fall within the true spirit and scope of the invention. With respect to the above description then, it is to be realized that the optimum relationships for the components and steps of the invention, including variations in order, form, content, function and manner of operation, are deemed readily apparent and obvious to one skilled in the art, and all equivalent relationships to those illustrated in the drawings and described in the specification are intended to be encompassed by the present invention. The above description and drawings are illustrative of modifications that can be made without departing from the present invention, the scope of which is to be limited only by the following claims. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents are intended to fall within the scope of the invention as claimed.

What is claimed is:

1. A method of producing customized artwork comprising steps of:

forming a plurality of backdrops, each backdrop of the plurality of backdrops comprising an ornamental design formed in a metal sheet and a mounting area, the plurality of backdrops not being customized for users, and each backdrop of the plurality of backdrops having surfaces;

finishing the plurality of backdrops, the finishing comprising treating the surfaces of each backdrop of the plurality of backdrops;

receiving an order for a customized artwork, the customized artwork comprising a selected backdrop and a customized component, the selected backdrop being one backdrop of the plurality of backdrops;

producing the customized component from another metal sheet, the customized component comprising a second ornamental design formed in the other metal sheet;

delivering the customized artwork.

2. The method of producing customized artwork according to claim 1, further comprising a step of storing the plurality of backdrops as inventory after forming the plurality of backdrops.

3. The method of producing customized artwork according to claim 1, further comprising a step of determining whether to assemble the customized artwork by fastening the customized component to the mounting area of the selected backdrop, before delivering the customized artwork.

4. The method of producing customized artwork according to claim 1, the step of forming a plurality of backdrops comprising, for each backdrop, cutting the ornamental design in the metal sheet for each backdrop.

5. The method of producing customized artwork according to claim 1, the step of forming a plurality of backdrops comprising, for each backdrop, engraving the ornamental design in the metal sheet for each backdrop.

6. The method of producing customized artwork according to claim 1, the step of forming a plurality of backdrops comprising, for each backdrop, cutting and engraving the ornamental design in the metal sheet for each backdrop.

7. The method of producing customized artwork according to claim 1, the step of producing the customized component comprising cutting the second ornamental design in the other metal sheet for the customized component.

8. The method of producing customized artwork according to claim 1, the step of producing the customized component comprising engraving the second ornamental design in the other metal sheet for the customized component.

9. The method of producing customized artwork according to claim 1, the step of producing the customized component comprising cutting and engraving the second ornamental design in the other metal sheet for the customized component.

10. The method of producing customized artwork according to claim 1, further comprising a step of determining whether to insulate the customized component from the selected backdrop to hinder galvanic corrosion, the step of determining whether to insulate the customized component from the selected backdrop being performed after receiving the order for the customized artwork.

11. The method of producing customized artwork according to claim 10, the step of determining whether to insulate the customized component from the selected backdrop comprising determining a first anodic index for the selected backdrop, and determining a second anodic index for the customized component.

12. The method of producing customized artwork according to claim 11, the step of determining whether to insulate the customized component from the selected backdrop further comprising determining a difference between the first anodic index for the selected backdrop and the second anodic index for the customized component.

13. The method of producing customized artwork according to claim 12, the step of determining whether to insulate the customized component from the selected backdrop further comprising determining if the difference between the first anodic index for the selected backdrop and the second anodic index for the customized component exceeds a determined amount.

14. The method of producing customized artwork according to claim 13, the step of determining whether to insulate the customized component from the selected backdrop further comprising determining to insulate if the difference between the first anodic index for the selected backdrop and the second anodic index for the customized component exceeds the determined amount.

15. The method of producing customized artwork according to claim 14, further comprising a step of assembling the customized artwork, the step of assembling including fastening the selected backdrop to the customized component and providing an insulator, the insulator being disposed between the selected backdrop and the customized component.

16. The method of producing customized artwork according to claim 15, the step of assembling including fastening the selected backdrop to the customized component with a plurality of fasteners.

17. The method of producing customized artwork according to claim 16, the step of fastening the selected backdrop to the customized component with a plurality of fasteners includes a step of providing an insulating flanged bushing for each fastener.

18. The method of producing customized artwork according to claim 17, the insulating flanged bushing for each fastener insulating each fastener from the backdrop.

19. The method of producing customized artwork according to claim 18, the insulating flanged bushing for each fastener insulating each fastener from the customized component.

20. The method of producing customized artwork according to claim 19, the step of forming a plurality of backdrops comprising, for each backdrop, cutting the ornamental design in the metal sheet for each backdrop and the step of producing the customized component comprising cutting the second ornamental design in the other metal sheet for the customized component.

* * * * *